US006206586B1

(12) United States Patent
Wen et al.

(10) Patent No.: US 6,206,586 B1
(45) Date of Patent: Mar. 27, 2001

(54) PROTECTIVE FILMS ON PHOTOGRAPHIC IMAGES

(75) Inventors: Xin Wen, Rochester; Kevin M. O'Connor, Webster; Susan E. Hanley, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/376,174

(22) Filed: Aug. 17, 1999

(51) Int. Cl.[7] ..... G03D 5/00; G03D 3/02
(52) U.S. Cl. ..... 396/604; 396/627
(58) Field of Search ..... 396/604, 627; 118/670, 696

(56) References Cited

U.S. PATENT DOCUMENTS

| | | | | |
|---|---|---|---|---|
| 3,946,398 | | 3/1976 | Kyser et al. | 347/70 |
| 4,279,945 | | 7/1981 | Audran et al. | 427/130 |
| 4,302,523 | | 11/1981 | Audran et al. | 430/140 |
| 4,612,875 | * | 9/1986 | Keable | 118/670 |
| 4,723,129 | | 2/1988 | Endo et al. | 347/56 |
| 5,027,146 | * | 6/1991 | Manico et al. | 396/604 |
| 5,228,920 | * | 7/1993 | Thompson III | 118/670 |
| 5,309,192 | * | 5/1994 | Lu | 396/620 |
| 5,354,379 | * | 10/1994 | Milbourn et al. | 118/696 |
| 5,853,965 | | 12/1998 | Haydock et al. | 430/496 |
| 5,866,282 | | 2/1999 | Bourdelais et al. | 430/22 |
| 5,874,205 | | 2/1999 | Bourdelais et al. | 430/496 |
| 5,888,643 | | 3/1999 | Aylward et al. | 428/315.9 |
| 5,888,681 | | 3/1999 | Gula et al. | 430/20 |
| 5,888,683 | | 3/1999 | Gula et al. | 430/22 |
| 5,888,714 | | 3/1999 | Bourdelais et al. | 430/536 |
| 5,960,224 | * | 9/1999 | Sanada et al. | 396/604 |
| 5,984,539 | * | 11/1999 | Patton et al. | 396/604 |

* cited by examiner

*Primary Examiner*—D. Rutledge
(74) *Attorney, Agent, or Firm*—Raymond L. Owens

(57) ABSTRACT

Apparatus for forming durable polymer protection film over a photographic image on a receiver includes an ink jet print head for ejecting a polymer protection fluid which when dried forms a film and the apparatus positions the receiver relative to the ink jet print head and causing the ink jet print head to apply the polymer fluid over the photographic image to form a polymer protection film when the fluid dries for protecting the photographic image.

9 Claims, 3 Drawing Sheets

PROTECTIVE FILMS ON PHOTOGRAPHIC IMAGES

CROSS REFERENCE TO RELATED APPLICATIONS

Reference is made to commonly assigned U.S. patent application Ser. No. 08/965,560 filed on Nov. 6, 1997, entitled "A Method and Apparatus of Applying a Solution of a Predetermined Viscosity to Photosensitive Material to Form a Protective Coating Thereon" by Patton et al, commonly assigned U.S. application Ser. No. 08/965,335 filed on Nov. 6, 1997, entitled "A Novel Protecting Layer for Gelatin based AGX Photographic Products" by Yau et al, commonly assigned U.S. patent application Ser. No. 09/325,077, filed Jun. 3, 1999, entitled "Forming Ink Images Having Protection Films" by Wen, the disclosures of which are incorporated herein by reference.

FIELD OF THE INVENTION

The present invention relates to forming protective film on developed photographic images on receivers.

BACKGROUND OF THE INVENTION

Silver halide photographic receivers contain light sensitive silver halide in a hydrophilic emulsion. An image is formed in the receiver by exposing the silver halide to light, or to other actinic radiation, and developing the exposed silver halide to reduce it to elemental silver.

In color photographic receivers a dye image is formed as a consequence of silver halide development by one of several different processes. The most common is to allow a by-product of silver halide development, oxidized silver halide developing agent, to react with a dye forming compound called a coupler. The silver and un-reacted silver halide are then removed from the photographic receiver, leaving a dye image.

The formation of the dye image commonly involves liquid processing with aqueous solutions that must penetrate the surface of the receiver to come into contact with silver halide and coupler. Gelatin and similar natural or synthetic hydrophilic polymers have been the common binder of choice for silver halide photographic receivers. Unfortunately, when gelatin and other similar polymers are not durable and mar-resistant enough for handling. The imaged receiver can be marked by fingerprints, it can be scratched or torn, it can also deform, swell or form image artifact when it is contacted with liquids.

Various coating techniques have been developed to provide a protection layer over the silver halide images. Some of these techniques require wet chemical coating and radiation treatment. Some of these techniques require the use of fusing particles and/or the use of electrostatic field. These operations are costly and complex.

The silver halide photographic images can also be protected by a lamination sheet. The lamination method suffer the following several drawbacks: first, the lamination sheet significantly increases the cost of the media per unit area. Second, the lamination machine is expensive. Third, the lamination has the tendency to delaminate over time or under physical or heat disturbance.

There remains a need for a simple, low-cost, and dry process for providing protection on photographic images without the drawbacks of the above described techniques.

SUMMARY OF THE INVENTION

An object of this invention is to provide protection for silver halide images on receivers without the drawbacks of the prior art techniques.

This object is achieved by apparatus for forming durable polymer protection film over a photographic image on a receiver, comprising:

a) means for providing a receiver having a photographic image;

b) fluid ejection means for ejecting a polymer protection fluid which when dried forms a film; and c) means for positioning the receiver relative to the fluid ejection means and causing the fluid ejection means to apply the polymer fluid over the photographic image to form a polymer protection film when the fluid dries for protecting the photographic image.

A feature of the present invention is that a polymer protection film is applied using a fluid ejection head such as an ink jet print head after the photographic image is developed. The fluid ejection head is positioned at a distance away from the silver halide photographic image.

An advantage of the present invention is that the polymer protection film is applied without the applicator being in contact with the surface of the silver halide photographic image, which reduces the probability of disturbing the silver halide images.

Another advantage of the present invention is that a polymer protection film can be formed effectively with apparatus in accordance with the present invention with significantly reduced material and equipment costs.

A further advantage of the present invention is that it does not involve volatile chemicals involved in the wet coating techniques in some prior art.

Yet another advantage of the present invention is that the thickness and the area of the polymer protection film can be controlled by a computer and control electronics.

DETAILED DESCRIPTION OF THE INVENTION

The present invention relates to a photographic development apparatus that provides a protect film over photographic images on receivers for improved durability. In the present invention, the term "durability" refers to image durability and image stability against physical abrasion, stability against water (i.e. water fastness), light fade (i.e. light fastness) and environmental conditions (oxidation etc.), and finger prints on the image.

Figure 1:
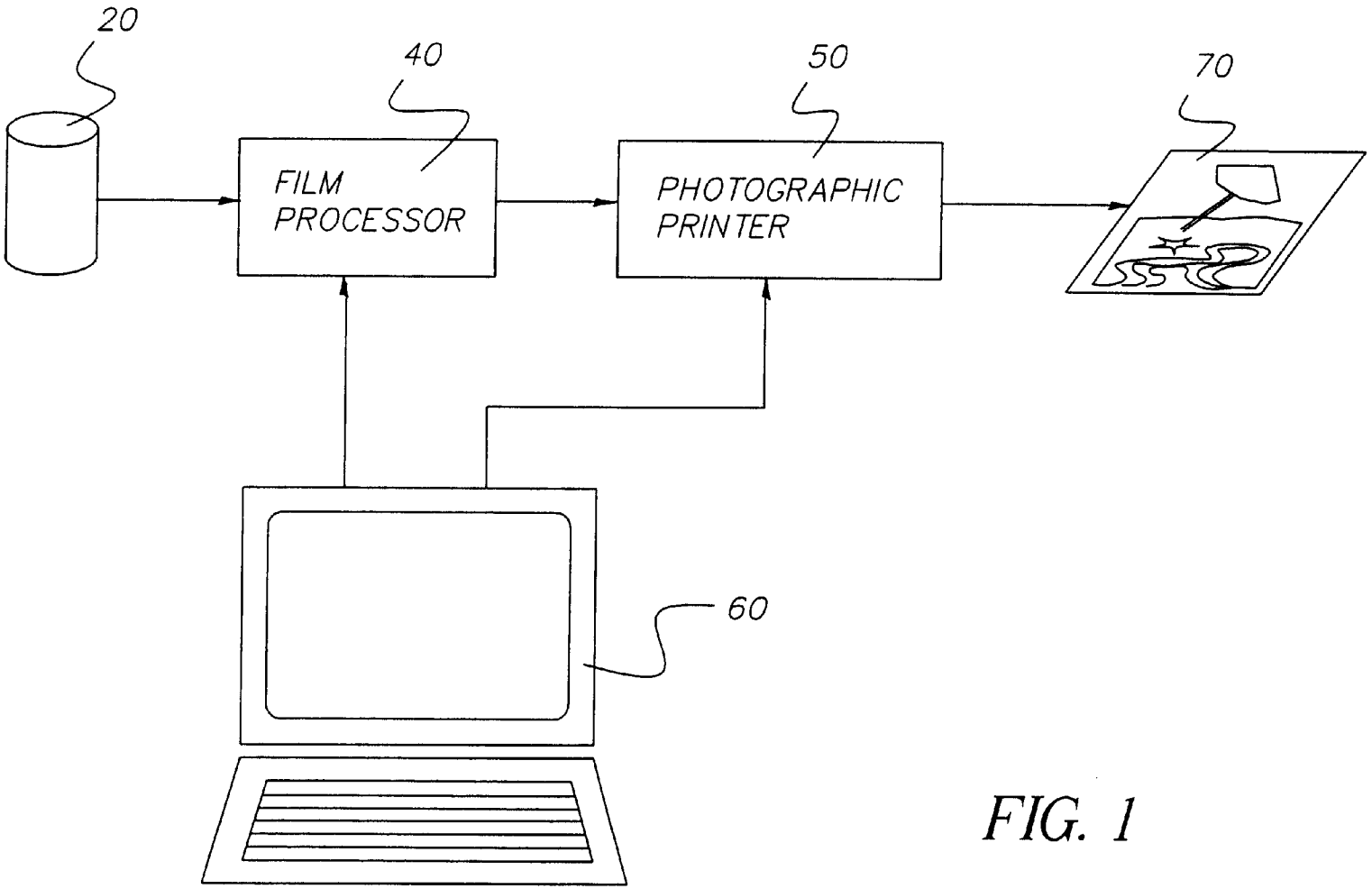
FIG. 1 is a schematic of a photographic development apparatus in accordance with the present invention.

Referring to FIG. 1, a photographic development apparatus 10 in accordance with the present invention includes a film processor 40, a photographic printer 50, and a computer 60. Under the control of the computer 60, the film processor 40 receives an undeveloped film 20, develops it in processing solutions well known in the art, and sends the developed photographic film to the photographic printer 50. The photographic printer 50 reproduces the images on the developed film on a photographic receiver such as a photographic paper. The imaged photographic receiver is then applied with a protection film. Finally, the finished photographic image 70 is ejected from the photographic printer 50.

Figure 2:
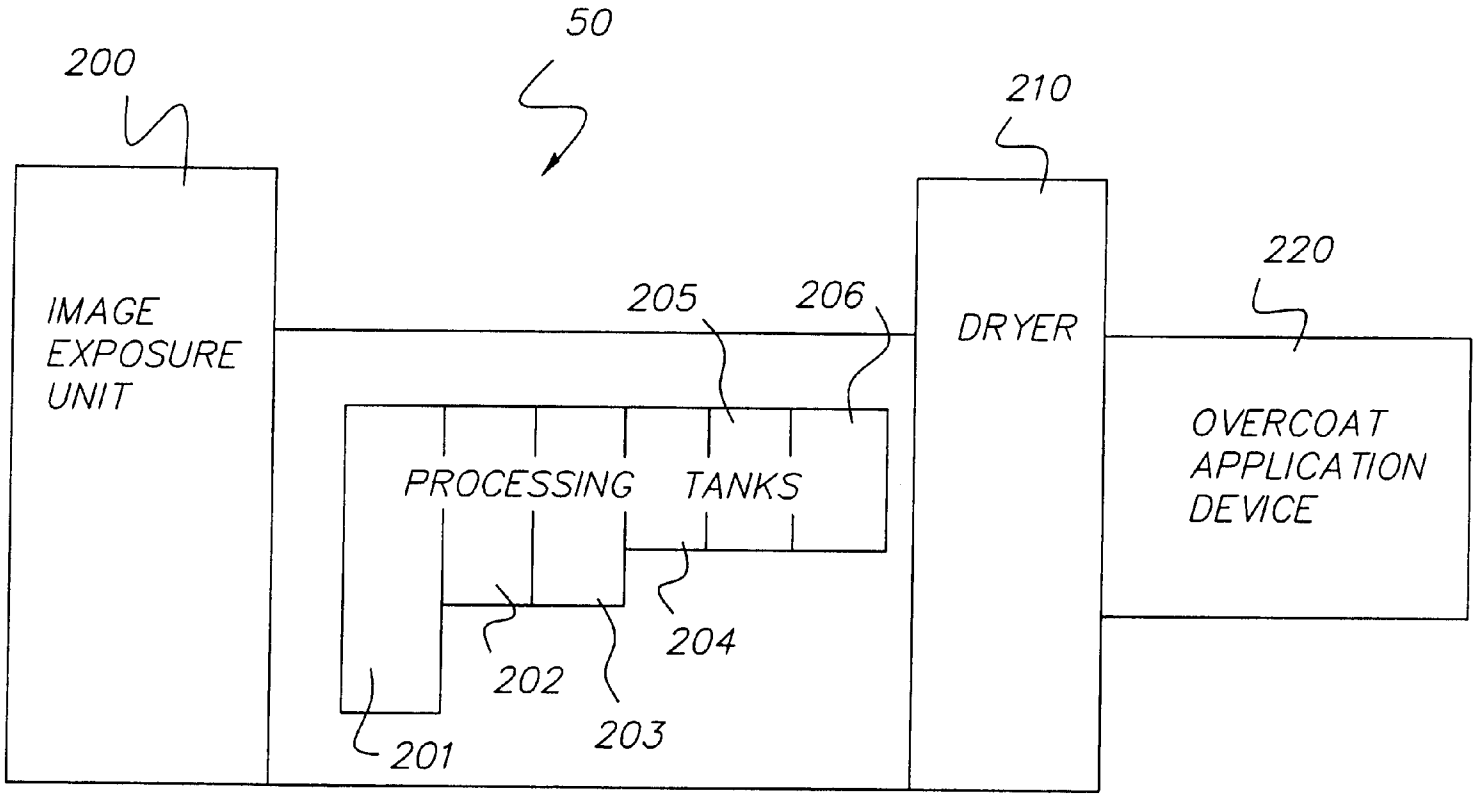
FIG. 2 is a detailed view of the photographic printer of the photographic development apparatus in FIG. 1.

The photographic printer 50, as shown in FIG. 2, includes an image exposure unit 200, processing tanks 201–206, a dryer 210, and an overcoat application device 220. The operations of the photographic printer 50 are controlled by the computer 60. The developed film is received by the image exposure unit 200. An image on the developed photographic film is projected on a photosensitive material coated on a receiver such as a photographic paper. After a controlled exposure time, a latent image corresponding to the image on the photographic film is reproduced on the photosensitive material. The photosensitive material carrying the latent image is subsequently processed by one or more solutions contained in processing tanks 201–206. The processing solutions in the processing tanks 201–206 can include developer solution, bleach solution, fixer solution, washing solution, or a combination of bleach/fix solution and wash/stabilizer solution. After the excess solutions are removed by washing, the wet photographic receiver is dried in the dryer 210. In accordance with the present invention, the dried photographic receiver is subsequently applied with a polymer protection film (385) in the overcoat application device 220. Finally, the finished photographic image 70 is delivered and subsequently sorted according to the requirement of the user.

Figure 3:
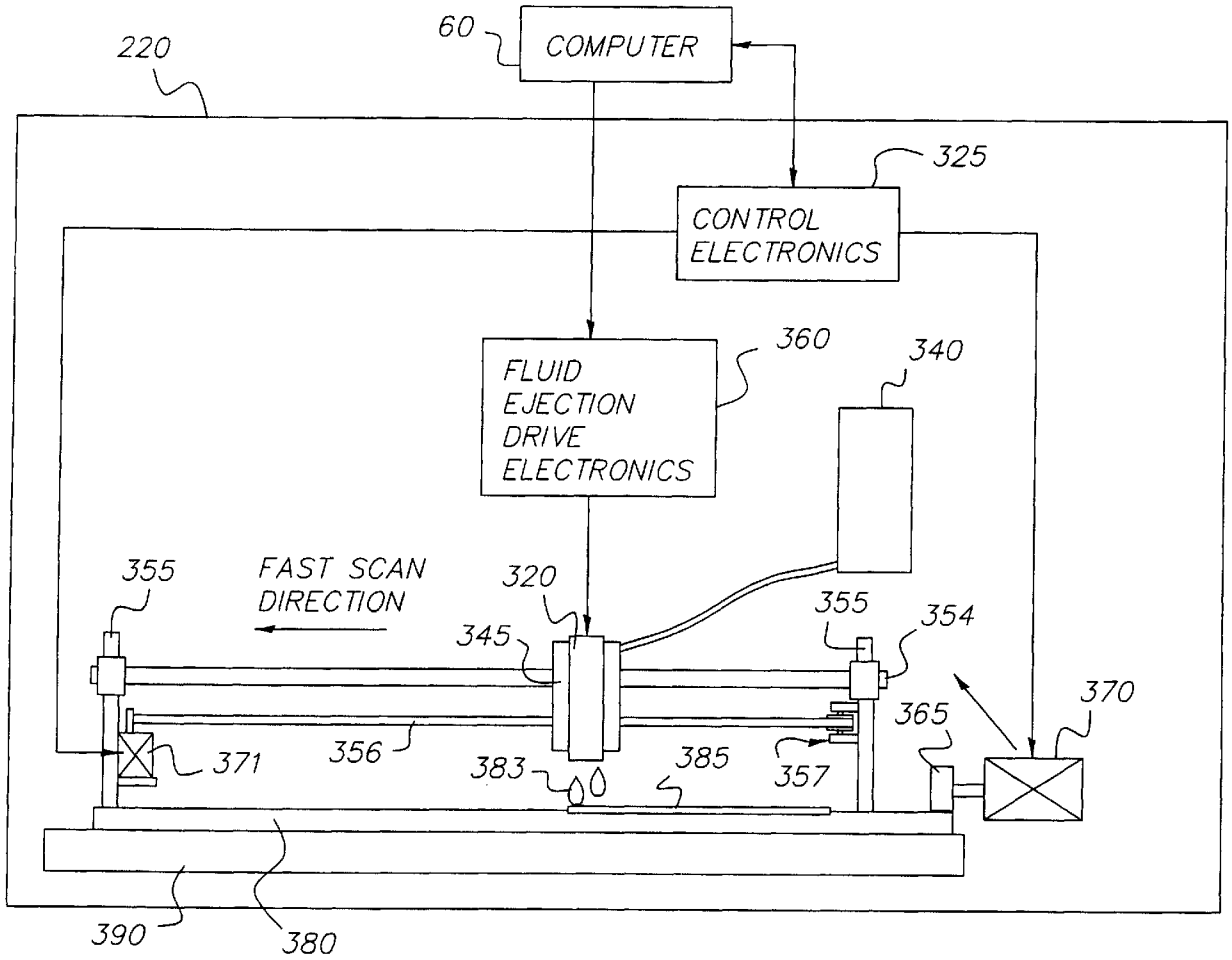
FIG. 3 is a detailed view of the overcoat application device of the photographic printer in FIG. 2.

Referring to FIG. 3, an overcoat application device 220 is controlled by the computer 60. The overcoat application device 220 also includes control electronics 325, a fluid ejection head 320, fluid reservoir 340, and fluid ejection drive electronics 360. The fluid reservoir 340 contains a polymer fluid that is supplied by the fluid ejection head 320. The fluid ejection head 320 is attached to a holder 345. The fluid ejection head 320 and the holder 345 are transported by a belt 356, a pulley mechanism 357, and the print head translation motor 371. The print head translation motor 371 can be a stepping motor or a DC motor with a servo-control system. The motor 371 moves the fluid ejection head 320 and the holder 345 along the gliding rail 354 in the fast scan direction. The gliding rail 354 is supported by supports 355. Although an ink jet print head is preferred for the fluid ejection head 360, other fluid ejection devices such as spray bar can also be used. The fluid ejection head 320 can also include a page-wide array of nozzles so that the roller 365 moves the photographic image 380 relative to the fluid ejection head 320 under the actuation of the receiver transport motor 370. In the present invention, the photographic image 380 is formed on a receiver that can be a reflective or transmissive material. The photographic image refers to both the image as well as the receiver wherein the image is printed on.

The fluid ejection head 320 is preferably an ink jet print head, either thermal ink jet or piezoelectric. Ink jet printing mechanisms include continuous ink jet or drop-on-demand ink jet. A thermal ink jet printer is disclosed in U.S. Pat. No. 4,723,129, issued to Endo et al. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. Other examples of the piezoelectric ink jet printers are the Epson Stylus Photo and Stylus Color printers.

The photographic image 380 is supported by the platen 390. The receiver transport motor 370 provides relative movement between the receiver 380 and the fluid ejection head 320 with a roller 365 that moves the photographic image 380 in a slow-scan direction that is orthogonal to the fast scan direction. It will be appreciated that both the receiver transport motor 370 and the print head translation motor 371 are bidirectional so that the fluid ejection head 320 and the photographic image 380 can be transported back to the starting position. The design of the roller 365 can be optimized to minimize contact with the photographic image 380. Such type of rollers (e.g. the V-shaped rollers) are disclosed in the above referenced commonly assigned U.S. patent application Ser. No. 08/965,560 filed on Nov. 6, 1997, entitled "A Method and Apparatus of Applying a Solution of a Predetermined Viscosity to Photosensitive Material to Form a Protective Coating Thereon" by Patton et al.

When an ink jet print head is used, the computer 60 controls the fluid ejection drive electronics 360 to deliver polymer fluid over the photographic image 380 in discrete ejected polymer fluid drop 383 (in a similar fashion to ink jet printing). A polymer protection film 385 is formed on the photographic image 380. The computer 60 controls the fluid ejection drive electronics 360 to determine the amount or the location of the polymer fluid applied on the photographic image 380. The polymer protection film 385 can be formed uniformly over the whole or part of the photographic image 380. The polymer protection film 385 is then dried and solidified to form a clear solid protection layer. An advantage of the present invention is that the polymer overcoat does not involve the contact of an applicator (e.g. a coating roller) with the photographic image 380 so that the overcoating process will not interfere with the photographic image.

The polymeric fluid can be an aqueous solution, polymer dispersion, polymer suspension, or a polymer melt, such as a resin or latex solution. The polymers can comprise a single type of monomer, or can be co-polymers comprising more than one type of monomer. The polymeric fluid can also include colloidal dispersions as disclosed in the above referenced, commonly assigned U.S. application Ser. No. 08/965,335 entitled "A Novel Protecting Layer for Gelatin based AGX Photographic Products" by Yau et al. The polymeric fluid can also include stabilizers, surfactants, viscosity modifiers, humectants, and other components. These additional components help the polymeric fluids to be effectively ejected out of the nozzles of the fluid ejection head 320, prevent the polymeric fluid from drying at the nozzles of the fluid ejection head 320, or assist the polymer fluids to properly coalesce over the photographic image 380. In addition, the polymeric fluid can also include lubricating agents to control the friction of the protective film formed. The polymeric fluid can also contain cross-linking agents useful in cross-linking the protective film to improve its physical properties. In another embodiment, the fluid ejection system can be used to deliver a liquid monomer which can then be polymerized by thermal treatment or exposure to actinic radiation, such as ultraviolet light, to form a solid protective film.

Examples of the polymer fluids tested in the present invention are described below. An Epson Color Stylus 200 printer is used to deliver the polymer fluids. The polymer fluids are applied to the ink cartridge for the piezoelectric print head on the Epson Color Stylus 200 printer. A block of foam material is placed in the cartridge to hold the polymer fluid and dampen the fluid motion during printing. The polymer fluids include 5% or 10% AQ polymer, or 2% polyvinyl pyridine, or 5% polyurethane in aqueous solution. Glycerol is also added to the polymer fluid as humectant at 5% concentration.

Imaged photographic receivers are among the image recording materials protected in accordance with this invention. Typically, the exemplified receivers are derived from silver halide photographic receivers that can be black and white receivers (for example, those which yield a silver image or those which yield a neutral tone image from a mixture of dye forming couplers), single color receivers or multicolor receivers. Multicolor receivers typically contain dye image-forming units sensitive to each of the three primary regions of the spectrum. The imaged receivers can be viewed by transmission, such as negative film images, reversal film images and motion picture prints or they can be imaged receivers that are viewed by reflection, such as paper prints. Because of the amount of handling that can occur with paper prints and motion picture prints, they are preferred imaged receivers for use in this invention.

The photographic receivers in which the images to be protected are formed can have the structures and components shown in Research Disclosure 37038. Specific photographic receivers can be those shown on pages 96–98 of Research Disclosure 37038 as Color Paper Elements 1 and 2. A typical multicolor photographic receiver comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The receiver can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, melt-extrusion-coated paper, and laminated papers, such as those described in U.S. Pat. Nos. 5,853,965; 5,866,282; 5,874,205; 5,888,643; 5,888,681; 5,888,683; and 5,888,714. Photographic receivers protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic receivers typically provide the silver halide in the form of an emulsion. Photographic emulsions generally include a vehicle for coating the emulsion as a layer of a photographic receiver. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic receivers can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic receivers in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative receiver, the receiver is treated with a color developer (that is one which will form the colored image dyes with the color couplers), and then with an oxidizer and a solvent to remove silver and silver halide. In the case of processing a color reversal receiver or color paper receiver, the receiver is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The photographic images 380 is fed into the Epson Color Stylus 200 printer. An image file was designed on a computer. The image included at least one area with a uniform density. The image file was sent to the Epson Color Stylus 200 printer. The polymer fluids as described above were delivered by the fluid ejection head 320 (that was piezoelectric print head) to form a polymer protection film 385 over the photographic image 380 in accordance to the image file. The location and the thickness of the polymer protection film 385 were controlled by designing the image. For example, one or two monolayer coverage of the polymer fluid were overcoated on the photographic image 380. Printing resolution (dot per inch), the number of fluid ejection drops per pixel, printing speed, drop volume for the delivery of the polymer fluids were also varied.

To properly protect the photographic image against finger print, oxidation and abrasion, the polymer protection film 385 is preferably continuous over the area of the photographic image 380 that needs to be protected. Strong chemical bonding is simultaneously formed between the polymer protection film 385 and the photographic image 380. As it is well known in the art, the polymerization can occur through drying in the air, and/or with the assistance of heating or radiation. The polymer protection film 385 is transparent for viewing of the photographic image. The polymer protection film 385 protected the photographic images 380 with enhanced image durability.

The thickness of the polymeric protection film can be varied by controlling the thickness of the polymer protection film 385. In the present invention, it is found that after solidified, the polymer protection film 385 (FIG. 3) should be at least 0.5 micron in mean thickness, preferably, in the range of 1 to 10 microns, for providing appropriate photographic image protection. The thickness of the wet polymer protection film 385 is typically thicker than its thickness after the solidification. It is found that satisfactory gloss can be provided by a smooth surface in the polymer protection film which can be achieved by uniformly delivering fluid ejection drops 383 over an area of the photographic image 380. Uniformity of the polymer protection film 385 can be enhanced by increasing the number of printing passes over each area.

The polymer protection film 385 prevents the physical abrasion and environmental contamination on the photographic image. The durability is therefore improved. Finger prints on the polymer protection film 385 can be easily wiped off. The chemical bonding between the polymer protection film 285 and the photographic image 380 also prevents the de-lamination problem associated with the lamination sheet in the prior art.

The invention has been described in detail with particular reference to certain preferred embodiments thereof, but it will be understood that variations and modifications can be effected within the spirit and scope of the invention.

PARTS LIST

| | |
|---|---|
| 10 | photographic development apparatus |
| 20 | undeveloped film |
| 40 | film processor |
| 50 | photographic printer |
| 60 | computer |
| 70 | finished photographic image |
| 200 | image exposure unit |
| 201 | processing tank |
| 202 | processing tank |
| 203 | processing tank |
| 204 | processing tank |
| 205 | processing tank |
| 206 | processing tank |
| 207 | processing tank |
| 210 | dryer |
| 220 | overcoat application device |
| 320 | fluid ejection head |
| 325 | control electronics |
| 340 | fluid reservoir |
| 345 | holder |
| 354 | pulley mechanism |
| 356 | belt |
| 360 | fluid ejection drive electronics |
| 365 | roller |
| 370 | receiver transport motor |
| 371 | print head translation motor |
| 380 | photographic image |
| 383 | ejected polymer fluid drop |
| 385 | polymer protection film |
| 390 | platen |

What is claimed is:

1. Apparatus for forming durable polymer protection film over a photographic image on a receiver, comprising:

a) a film processor for providing a receiver having a photographic image;

b) fluid ejection means including nozzles spaced from the receiver for ejecting a polymer protection fluid which when dried forms a film and c) means for positioning the receiver relative to the fluid ejection means and causing the fluid ejection means to apply the polymer fluid over the photographic image to form a polymer protection film when the fluid dries for protecting the photographic image.

2. The apparatus of claim 1 wherein the fluid ejection means includes an ink jet print head.

3. The apparatus of claim 1 wherein the polymer fluid is ejected in the form of discrete fluid drops.

4. The apparatus of claim 1 wherein the polymer protection film has a thickness equal to or greater than 0.5 micron.

5. The apparatus of claim 1 wherein the polymer protection film has a thickness equal to or greater than 1 micron.

6. The apparatus of the claim 1 wherein the polymer fluid is an aqueous polymer solution or dispersion.

7. The apparatus of claim 1 wherein the fluid ejection means further includes fluid ejection drive electronics for controlling the application of the polymer fluid over the photographic image.

8. Apparatus for forming durable polymer protection film over a photographic image on a receiver, comprising:

a) a film processor for forming a photographic image on the receiver;

b) a print head including nozzles for ejecting a polymer protection fluid which when dried forms a film and such print head being spaced from the receiver; and c) means for moving the receiver in a first direction and for moving the print head in a second direction across the receiver and for causing the print head to apply the polymer fluid over the photographic image to form a polymer protection film when the fluid dries for protecting the photographic image.

9. Photographic processing apparatus for forming a photographic image on a receiver and a durable polymer protection film over the photographic image, comprising:

a) a film processor for developing a photographic latent image;

b) a photographic printer for projecting the developed photographic image onto the receiver and for developing the photographic image on the receiver;

c) a print head including nozzles for ejecting a polymer protection fluid which when dried forms a film and such print head being spaced from the receiver; and d) control means for controlling the operation of the film processor, the photographic printer, and the print head including i) means for moving the receiver having the photographic image in a first direction;

ii) means for moving the print head in a second direction across the receiver having the photographic image; and iii) means for causing the print head to apply the polymer fluid over the photographic image to form a polymer protection film when the fluid dries for protecting the photographic image.

* * * * *